US011478901B2

(12) United States Patent
Ribic, Sr. et al.

(10) Patent No.: US 11,478,901 B2
(45) Date of Patent: Oct. 25, 2022

(54) PNEUMATIC FIXTURE CLAMP

(71) Applicant: Rimeco Products, Inc., Willoughby, OH (US)

(72) Inventors: John Ribic, Sr., Chardon, OH (US); Valentin Ribic, Chardon, OH (US); Rok Ribic, Kirtland, OH (US); John Ribic, Jr., Kirtland, OH (US)

(73) Assignee: RIMECO PRODUCTS, INC., Willoughby, OH (US)

( * ) Notice: Subject to any disclaimer, the term of this patent is extended or adjusted under 35 U.S.C. 154(b) by 335 days.

(21) Appl. No.: 16/892,933

(22) Filed: Jun. 4, 2020

(65) Prior Publication Data

US 2021/0379734 A1 Dec. 9, 2021

(51) Int. Cl.
*B25B 5/00* (2006.01)
*B25B 5/06* (2006.01)

(52) U.S. Cl.
CPC ..... *B25B 5/061* (2013.01)

(58) Field of Classification Search
CPC ..... B25B 1/00; B25B 1/22; B25B 1/2405; B25B 5/02; B25B 5/04; B25B 11/00; B25B 11/02; B25B 5/061
See application file for complete search history.

(56) References Cited

U.S. PATENT DOCUMENTS 1,934,411 A 11/1933 Dahlman
2,522,142 A 9/1950 Smith
2,655,384 A 10/1953 Peterson
3,168,854 A 2/1965 Neilson
5,743,687 A 4/1998 Ribic et al.
5,810,344 A 9/1998 Nishimoto
5,961,261 A 10/1999 Stark
6,139,002 A * 10/2000 Stark ..... B23Q 3/18 269/309
8,231,118 B2 * 7/2012 Tozaki ..... B23P 19/06 269/71
8,579,271 B2 * 11/2013 Yabe ..... B23Q 1/5437 269/37
8,585,031 B2 11/2013 Stark
(Continued)

FOREIGN PATENT DOCUMENTS

EP 1208937 6/2002

*Primary Examiner* — Lee D Wilson
(74) *Attorney, Agent, or Firm* — Rankin, Hill & Clark LLP

(57) ABSTRACT

According to one aspect, a pneumatic fixture clamp includes a housing having a rotational axis and a housing exterior surface. The housing exterior surface includes a workpiece engagement surface intersected by the rotational axis and configured for engaging a workpiece assembly, and a turntable engagement surface disposed on a side of the housing opposite the workpiece engagement surface, intersected by the rotational axis, and configured for engaging a turntable of a machine center. A chamber is defined in the housing between the workpiece engagement surface and the turntable engagement surface along the rotational axis. A piston slidably disposed in the chamber and configured for being driven between an extended position and a retracted position relative to the chamber. A fluid passage is defined in the housing, connected to the chamber, and configured for providing fluid from a fluid line to the chamber.

20 Claims, 8 Drawing Sheets

(56) References Cited

U.S. PATENT DOCUMENTS

| | | | | |
|---|---|---|---|---|
| 2005/0029728 | A1* | 2/2005 | Kuroda | B23Q 16/00 269/309 |
| 2006/0279034 | A1* | 12/2006 | Yonezawa | B23Q 1/009 269/309 |
| 2015/0054211 | A1* | 2/2015 | Hediger | B23Q 1/0072 269/309 |

* cited by examiner

PNEUMATIC FIXTURE CLAMP

BACKGROUND

Conventional work holders for machine tools are generally designed to provide sufficient clamping force so that the cutting element will not displace the workpiece, and in many cases are pneumatically controlled. However, the pneumatic controls of conventional work holders are often bulky, difficult to install, or are otherwise incompatible with a work space provided in a five axis machining center. For example, as shown in FIG. 1 of the present application, U.S. Pat. No. 5,743,687 discloses a pneumatic, rotatable clamp which enables a work holder to secure a fixture and workpiece. In its disclosure, U.S. Pat. No. 5,743,687 provides a clamp and a pneumatic servomechanism separately disposed at opposite sides of a turntable, with the servomechanism extended behind the turntable. Notably, if this construction were employed in a five axis machining center having a turntable that pivots about more than one axis, the servomechanism disclosed in U.S. Pat. No. 5,743,687 would swing behind the turntable and cause interference between at least the servomechanism including associated air conduits, and supporting features of the machining center located behind the turntable at various rotated positions of the turntable.

SUMMARY

According to one aspect, a pneumatic fixture clamp includes a housing having a rotational axis and a housing exterior surface. The housing exterior surface includes a workpiece engagement surface intersected by the rotational axis and configured for engaging a workpiece assembly, and a turntable engagement surface disposed on a side of the housing opposite the workpiece engagement surface, intersected by the rotational axis, and configured for engaging a turntable of a machining center. A chamber is defined in the housing between the workpiece engagement surface and the turntable engagement surface along the rotational axis. A piston is slidably disposed in the chamber and configured for being driven between an extended position and a retracted position relative to the chamber. A drawbar has a proximal end connected with the piston such that the piston is configured for driving the drawbar between an extended state and a retracted state of the drawbar which respectively correspond with the extended position and the retracted position, and has a distal end connected to a clamping mechanism configured for releasably engaging a workpiece assembly. A fluid passage is defined in the housing, connected to the chamber, and configured for providing fluid from a fluid line to the chamber so as to drive the piston from the extended position toward the retracted position. A first fluid passage section is formed in the fluid passage, extending from the chamber and in fluid communication with the housing exterior surface, and a second fluid passage section is formed in the fluid passage, extending from the housing exterior surface and in fluid communication with the first fluid passage section.

DETAILED DESCRIPTION

Figure 1:
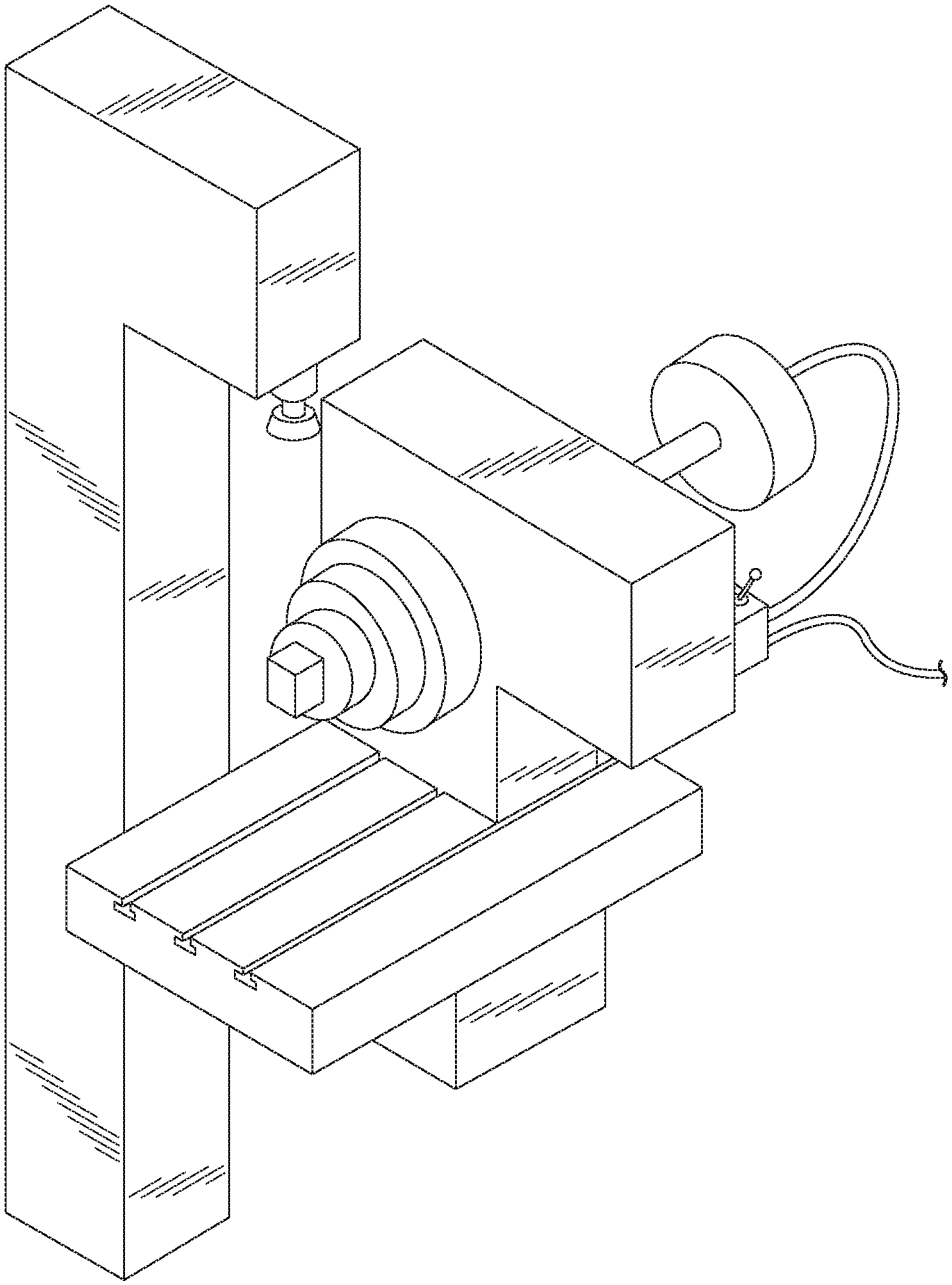
FIG. 1 is a perspective view of a prior art pneumatic, rotatable clamp installed on a four axis machining center.
Figure 2:
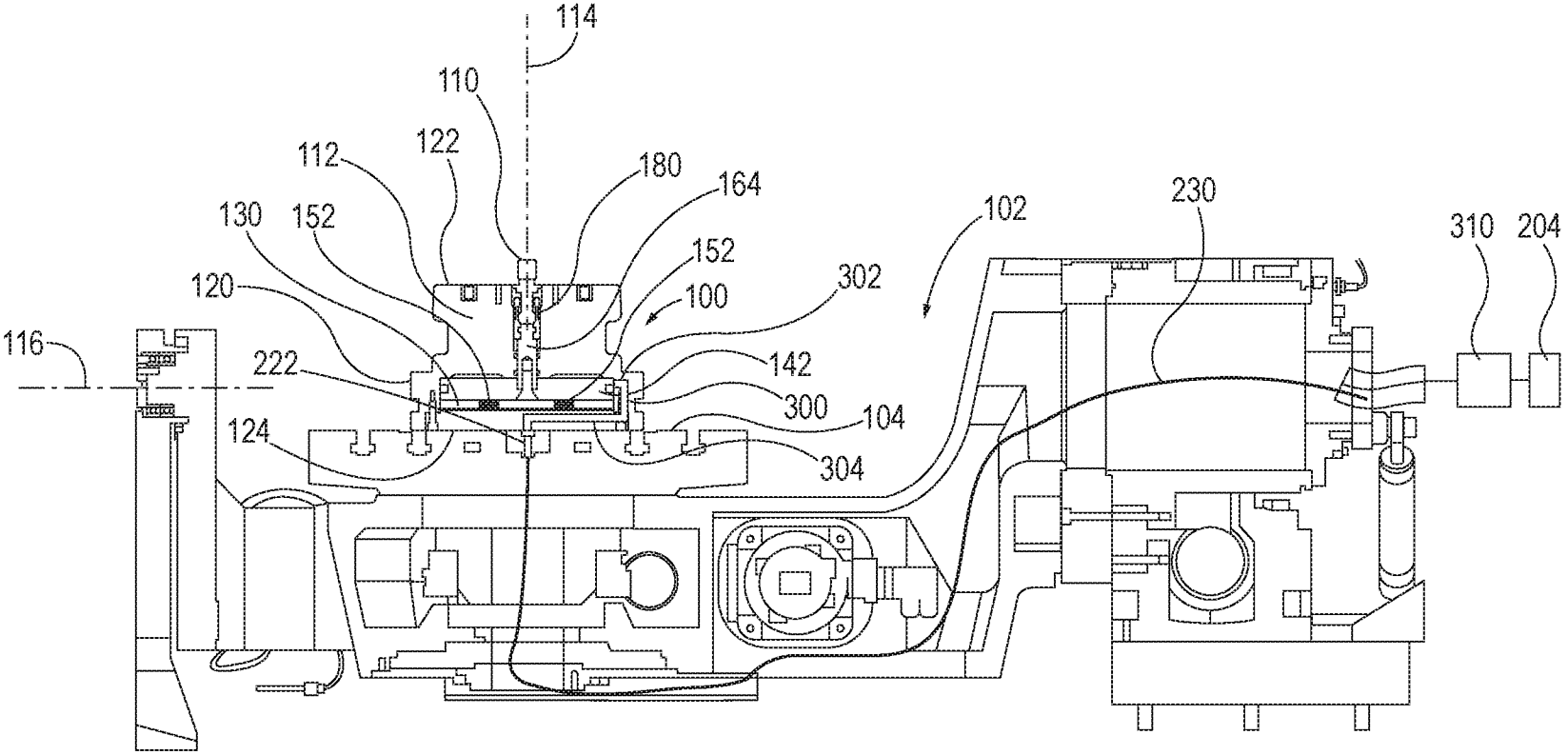
FIG. 2 is a cross-sectional view of a pneumatic fixture clamp installed on a five axis machining center shown in FIG. 2.

FIG. 2 depicts a pneumatic fixture clamp 100 installed on a machining center 102. The pneumatic fixture clamp 100 is supported on a turntable 104 of the machining center 102 and configured for securing a workpiece assembly 110 relative to the machining center 102. As depicted, the machining center 102 is configured to rotate a housing 112 of the pneumatic fixture clamp 100 with the turntable 104 about a first rotational axis 114 and a second rotational axis 116 orthogonal to the first rotational axis 114. Each of the first rotational axis 114 and the second rotational axis 116 have directions respectively defined by bearings that support the turntable 104 in the machining center 102. The housing 112 is positioned on the turntable 104, centered on the first rotational axis 114 such that a longitudinal axis of the housing 112 is collinear with the first rotational axis 114. With this construction, when the turntable 104 and by extension the housing 112 is in an upright position with respect to the machining center 102 as shown in FIG. 2, the first rotational axis 114 is vertical and the second rotational axis 116 is horizontal.

Figure 3:
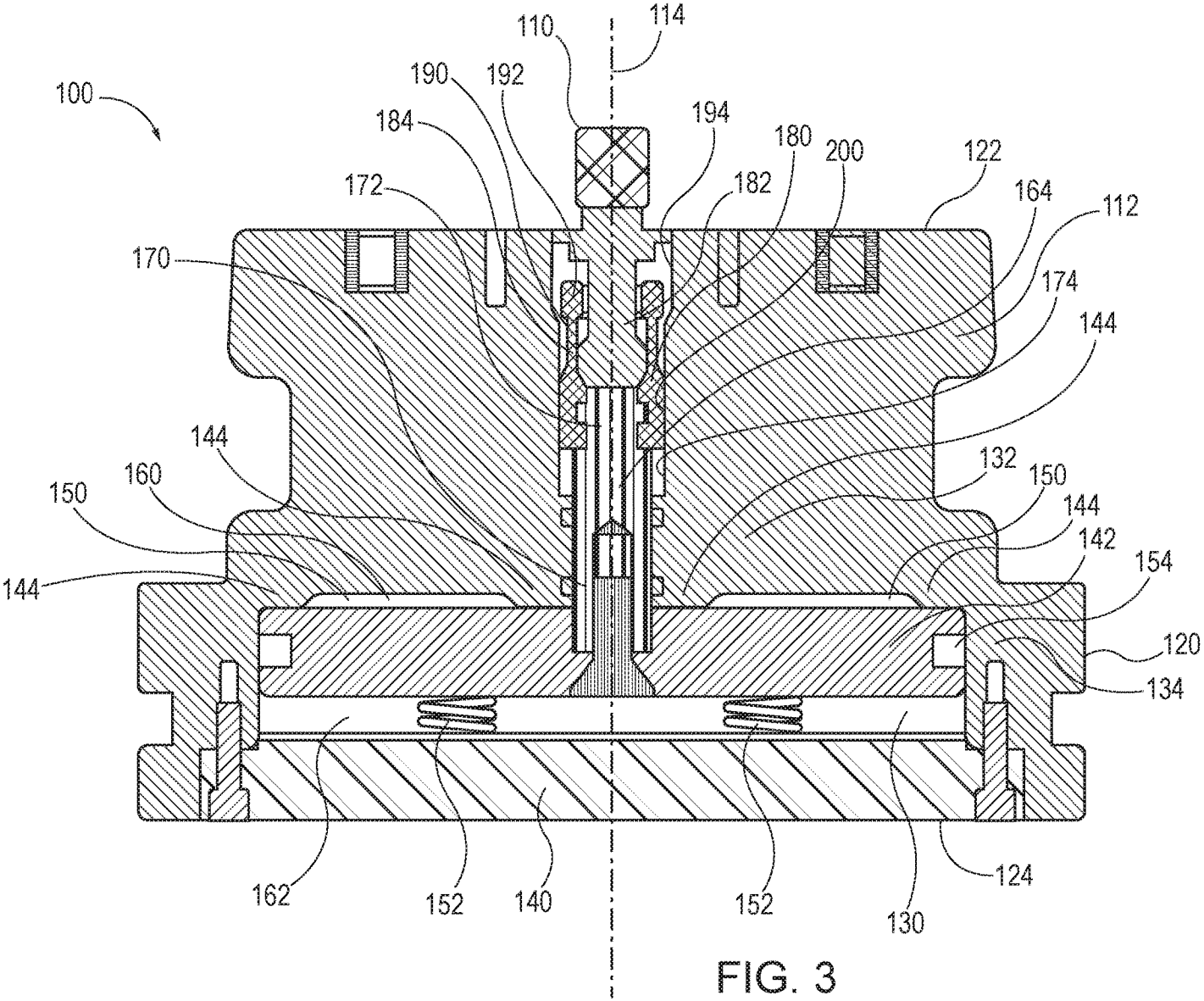
FIG. 3 is a cross-sectional view of the pneumatic fixture clamp shown in FIG. 2.

FIG. 3 depicts the pneumatic fixture clamp 100 including the housing 112, with a housing exterior surface 120 featuring a work engagement surface 122 and a turntable engagement surface 124. The work engagement surface 122 is a top surface of the housing 112 when the housing 112 is oriented in the upright position, and is configured for engaging the workpiece assembly 110. The workpiece assembly 110 includes at least a workpiece (not shown) and may further include a fixture, workholding device, or adaptor (not shown) configured for supporting the workpiece on the work engagement surface 122. As such, the work engagement surface 122 may receive a workpiece directly, or receive a fixture, workholding device, or adaptor configured for supporting the workpiece on the work engagement surface 122. The turntable engagement surface 124 is disposed on a side of the housing 112 opposite the work engagement surface 122, is intersected by the first rotational axis 114 and is configured for engaging the turntable 104 of the machining center 102.

A chamber 130 is defined in the housing 112 between the work engagement surface 122 and the turntable engagement surface 124 along the first rotational axis 114. The housing 112 is formed from a housing top portion 132 located above the chamber 130 when the housing 112 is oriented in the upright position, extending from the chamber 130 to the work engagement surface 122; a housing wall portion 134 disposed around the chamber 130, extending radially from the chamber 130 to the housing exterior surface 120; and a housing bottom portion 140 located below the chamber 130, extending from the chamber 130 to the turntable engagement surface 124.

Figure 4:
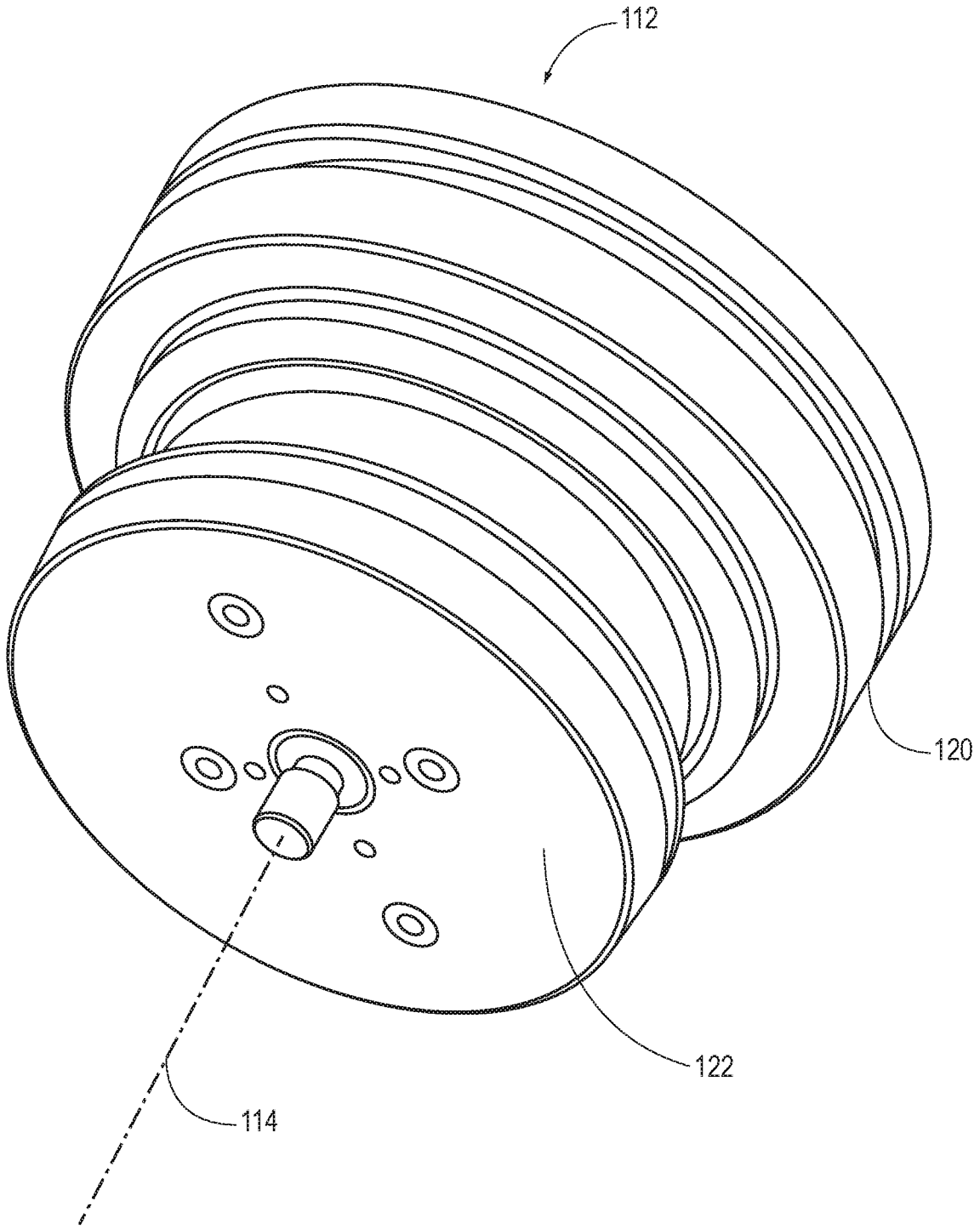
FIG. 4 is a perspective view of the pneumatic fixture clamp.

As depicted in FIG. 4, the housing exterior surface 120 is substantially rounded with respect to the first rotational axis 114. In this manner, the housing 112 is configured to rotate about the first rotational axis 114 relative to the machining center 102 without substantially changing a footprint of the housing 112 with respect to a work space defined in the machining center 102. As a result, when the housing 112 is installed in the machining center 102, the housing 112 may rotate freely about the first rotational axis 114 without causing interference between the housing exterior surface 120 and the machining center 102.

With reference to FIG. 3, a piston 142 is slidably disposed in the chamber 130 and configured for being driven between an extended position and a retracted position relative to the chamber 130. As shown, when the piston 142 is disposed in the extended position, the piston 142 is disposed toward the housing top portion 132 and abuts raised top portion sections 144 extended into the chamber 130 from the housing top portion 132. Because the piston 142 is substantially flat when taken from a side view as in FIG. 3 and the raised top portion sections 144 make the chamber 130 uneven at the housing top portion 132, a gap 150 forms between the housing top portion 132 and the piston 142 when the piston 142 is in the extended position abuts the raised top portion sections 144.

At least one spring 152 is interposed between the piston 142 and the chamber 130. As shown, the at least one spring 152 is seated on the housing bottom portion 140 and configured to bias the piston 142 toward the extended position. An O-ring 154 disposed circumferentially around the piston 142 maintains contact with the housing wall portion 134 as the piston 142 is actuated between the extended position and the retracted position. In this manner the O-ring 154 seals a first chamber part 160 from a second chamber part 162, where the gap 150 is formed in the first chamber part 160 and the at least one spring 152 occupies the second chamber part 162.

A drawbar 164 fixed with the piston 142 includes a drawbar proximal end 170 and a drawbar distal end 172. The drawbar 164 extends from the piston 142 and through the first chamber part 160, with the drawbar proximal end 170 connected to the piston 142 in the chamber 130. The drawbar distal end 172 is spaced from the drawbar proximal end 170 along a length of the drawbar 164 and disposed in a bore 174 defined in the housing top portion 132. The bore 174 extends through the housing top portion 132 to the housing exterior surface 120, and the drawbar 164 is disposed entirely in the housing 112 between the chamber 130 and the bore 174.

With continued reference to FIG. 3, the drawbar distal end 172 is connected to a clamping mechanism 180 configured for releasably engaging a retention stud 182 of the workpiece assembly 110. Because the piston 142 is fixed with the drawbar 164 and configured for being driven between the extended position and the retracted position, the piston 142 is configured for driving the drawbar 164 between an extended state and a retracted state which respectively correspond with the extended position and the retracted position of the piston 142.

The clamping mechanism 180 is disposed entirely in the bore 174 and includes a clamping wall 184 configured for releasably engaging the retention stud 182 when actuated from an open position to a locked position. The clamping wall 184 has a proximal clamping wall portion 190 that is relatively thin as compared to a distal clamping wall portion 192 extended from the proximal clamping wall portion 190, the distal clamping wall portion 192 being relatively thick as compared to the proximal clamping wall portion 190.

The bore 174 has a first bore section 194 that features a relatively wide inner diameter as compared to a second bore section 200, which is relatively narrow as compared to the first bore section 194. The distal clamping wall portion 192 occupies the first bore section 194 when the clamping mechanism 180 is in the open position, and the distal clamping wall portion 192 occupies the second bore section 200 when the clamping mechanism 180 is in the locked position. As such, when the clamping mechanism 180 is actuated from the open position to the locked position, the distal clamping wall portion 192 moves to occupy a relatively narrow section of the bore 174. A width of the distal clamping wall portion 192 in the first bore section 194 is wider than an inner diameter of the second bore section 200 such that the proximal clamping wall portion 190 is enabled to pivot, moving the distal clamping wall portion 192 radially outward with respect to the first rotational axis 114 so as to release the workpiece assembly 110 from the housing 112, when the clamping mechanism 180 is actuated from the locked position to the open position. When the clamping mechanism 180 is actuated from the open position to the locked position, the distal clamping wall portion 192 is restricted radially inward by the bore 174 toward the first rotational axis 114 such that the clamping mechanism 180 is closed over the retention stud 182 and the workpiece assembly 110 is locked with the housing 112.

Because the drawbar distal end 172 is fixed with the clamping mechanism 180 and the drawbar 164 is configured for being driven between the extended state and the retracted state, the drawbar 164 is configured for driving the clamping mechanism 180 between the open position and the locked position where the open position and the locked position respectively correspond with the extended state and the retracted state of the drawbar 164, and also respectively correspond with the extended position and the retracted position of the piston 142. Also, because the piston 142 is biased toward the extended position, the clamping mechanism 180 is biased toward the open position.

Figure 5:
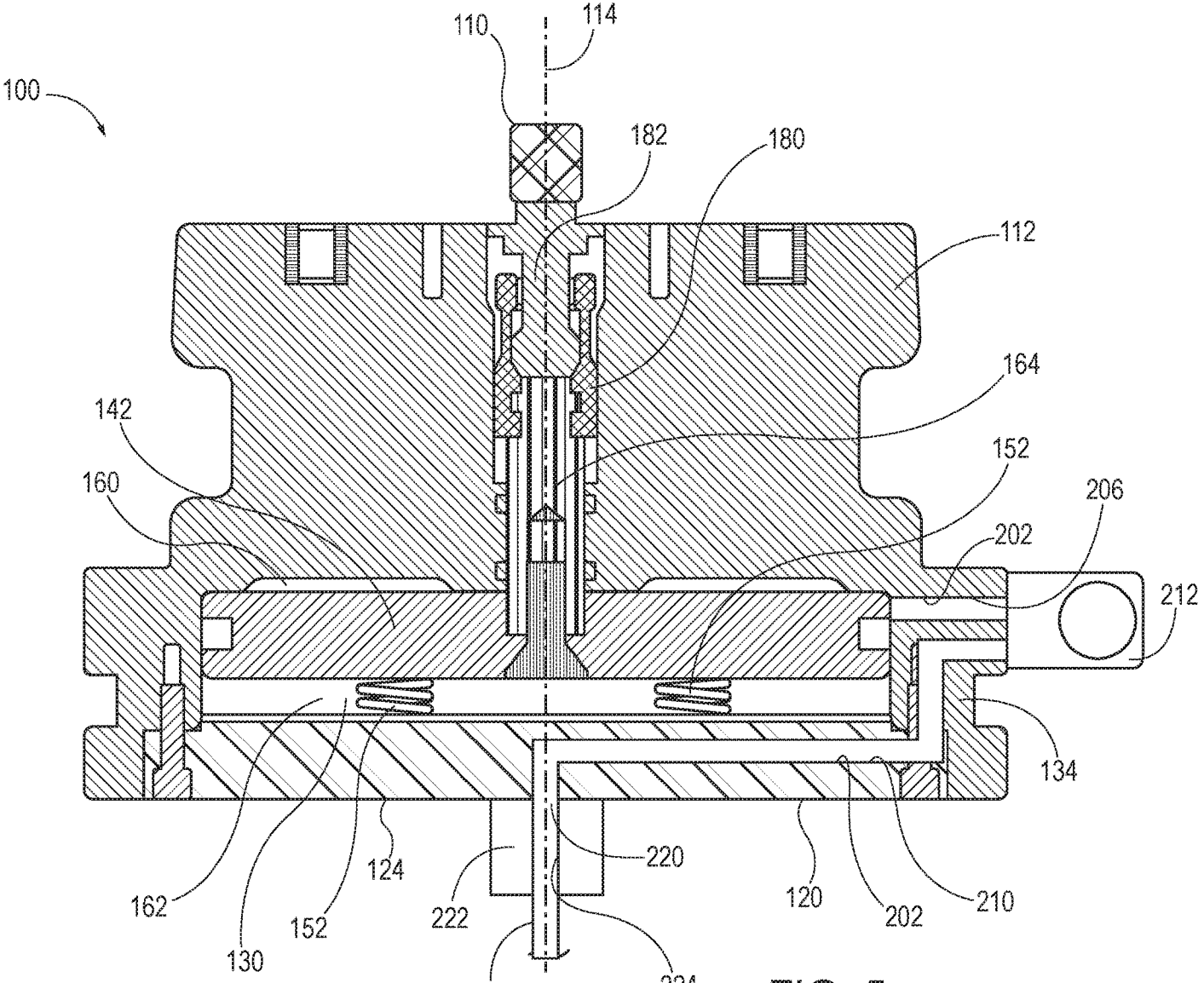
FIG. 5 is a cross-sectional view of the pneumatic fixture clamp according to an aspect of the present disclosure.

According to an embodiment of the pneumatic fixture clamp 100 depicted in FIG. 5, a fluid passage 202 defined in the housing 112 is configured for providing fluid to the chamber 130 by connecting the first chamber part 160 with a pressure source 204 (See FIG. 2), and alternatively relieving fluid from the chamber 130 by connecting the first chamber part 160 with ambient atmosphere. When the fluid passage 202 connects the chamber 130 to the pressure source 204 and the pressure source 204 is actuated, an increased pressure in the first chamber part 160 drives the piston 142 to the retracted position, against the bias imposed on the piston 142 by the at least one spring 152. As a result, the drawbar 164 is driven toward the retracted state and consequently the clamping mechanism 180 is driven toward the locked position, locking the workpiece assembly 110 with the clamping mechanism 180. With this construction, taken as a whole, the pneumatic fixture clamp 100 is biased toward an unlocked configuration with respect to the workpiece assembly 110 and is pneumatically driven toward a locked configuration with respect to the workpiece assembly 110.

The fluid passage 202 includes a first fluid passage section 206 and a second fluid passage section 210. As shown, the first fluid passage section 206 extends from the chamber 130 to a valve 212 and is entirely defined in the housing 112. More specifically, the first fluid passage section 206 is entirely defined in the housing wall portion 134 between the chamber 130 and the valve 212, extending in a radial direction of the housing 112 that is perpendicular to the first rotational axis 114. The second fluid passage section 210 is connected to the valve, extends between two points of the housing exterior surface 120, and is entirely defined in the housing 112. More specifically, the second fluid passage section 210 extends from the turntable engagement surface 124 of the housing 112 at a point centered on the first rotational axis 114, forming an opening 220 centered on the first rotational axis 114 at the turntable engagement surface 124 of the housing 112. The second fluid passage section 210 extends through the housing bottom portion 140 from the first rotational axis 114, and through the housing wall portion 134 to the valve 212. With this construction, the second fluid passage section 210 is entirely defined in the housing bottom portion 140 and the housing wall portion 134.

The valve 212 is connected to the fluid passage 202 between the first fluid passage section 206 and the second fluid passage section 210 to selectively bring the first fluid passage section 206 in fluid communication with the second fluid passage section 210. The valve 212 has an outlet configured for selectively exhausting fluid to the ambient atmosphere. In a first operating position, the valve 212 brings the chamber 130 in fluid communication with the pressure source 204 by bringing the first fluid passage section 206 in fluid communication with the second fluid passage section 210. In a second operating position, the valve 212 brings the chamber 130 in fluid communication with the ambient atmosphere by bringing the first fluid passage section 206 in fluid communication with the ambient atmosphere.

A fitting 222 is disposed on the housing exterior surface 120 and defines a passage 224 that continues the fluid passage 202 and connects the fluid passage 202 with a fluid line 230 configured to supply fluid from the pressure source 204 to the pneumatic fixture clamp 100. As shown, the fluid passage 202 at the fitting 222 is defined through the turntable engagement surface 124. With continued reference to FIG. 5, the fitting 222 is disposed on the turntable engagement surface 124 of the housing 112 and is centered on the first rotational axis 114. Because the fitting 222 is centered on the first rotational axis 114, the fitting 222 is configured to rotate with the housing 112 in the machining center 102 about the first rotational axis 114, without the rotation substantially changing a footprint of the fitting 222 with respect to the housing 112 or the machining center 102.

Notably, a flow path of the fluid includes each of the first chamber part 160, the fluid passage 202, the pressure source 204, the valve 212, the fitting 222, and the fluid line 230. The fluid may be a gas, such as compressed air, and may alternatively be a liquid suitable for selectively introducing and maintaining pressure from the pressure source 204 in the first chamber part 160. As such, the first chamber part 160, the fluid passage 202, the pressure source 204, the valve 212, the fitting 222, and the fluid line 230 are each configured to functionally communicate a gas or a liquid with respect to the pneumatic fixture clamp 100, in accordance with the physical embodiment of the fluid.

The valve 212 is mounted on the housing exterior surface 120 at the housing wall portion 134, and occupies a same longitudinal position relative to the housing 112 along the first rotational axis 114 as the chamber 130. The valve 212 is configured for remote operation and, in an embodiment of the pneumatic fixture clamp 100, the valve 212 is configured for operation from a machine user interface (not shown). The valve 212 can be solenoid-actuated valve having a wireless receiver and power source. The wireless receiver can receive wireless signals from an operator, for example, which can control the solenoid to change the operating position of the valve 212.

Figure 6:
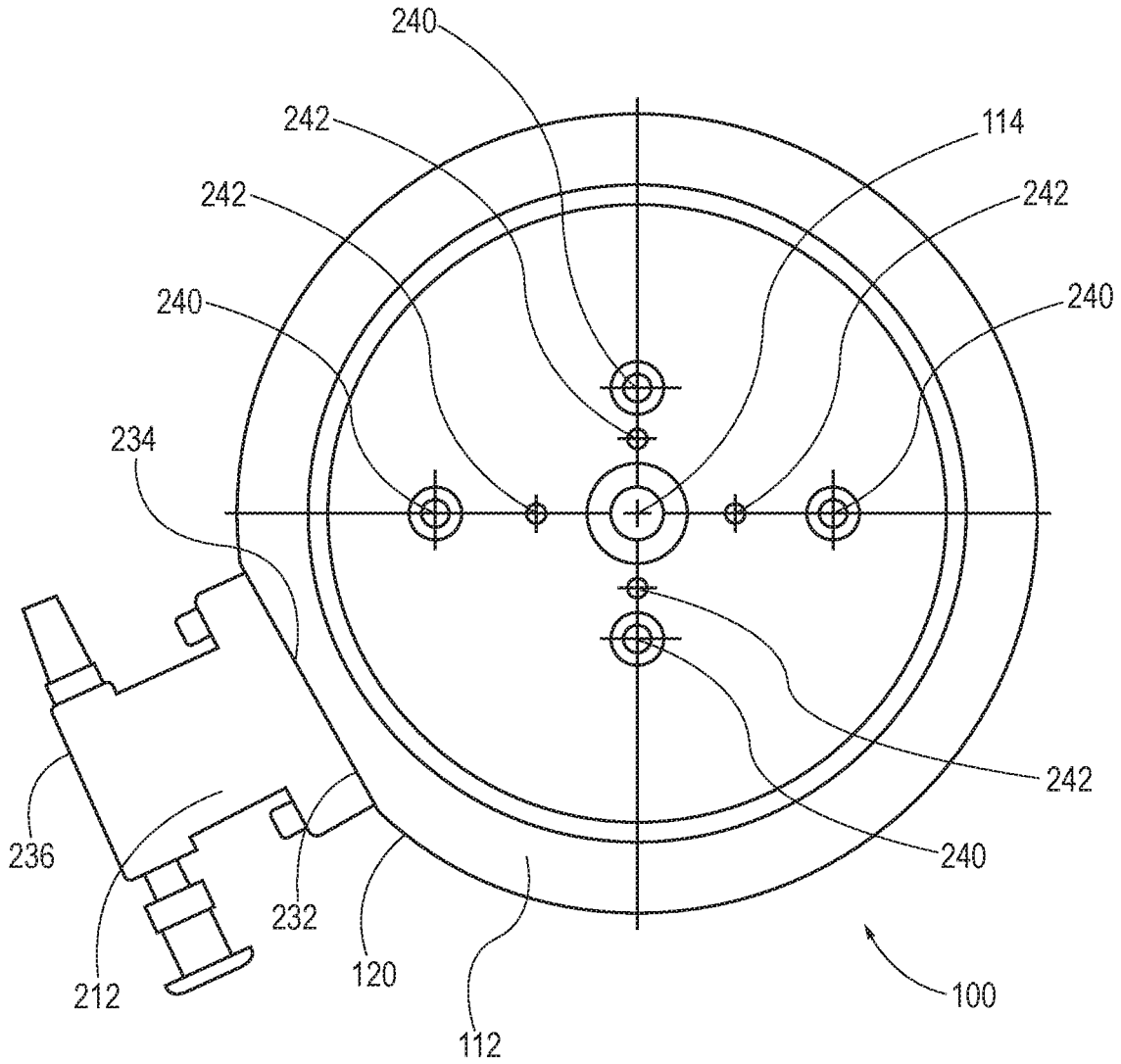
FIG. 6 is a top view of the pneumatic fixture clamp shown in FIG. 5.

As shown in FIG. 6, the housing exterior surface 120 is substantially rounded with respect to the first rotational axis 114, except for a flat section 232 on which the valve 212 is mounted, the flat section 232 being formed in the housing exterior surface 120. The housing exterior surface 120 at the flat section 232 is located closer to the first rotational axis 114 as compared to the housing exterior surface 120 at a same longitudinal position of the housing 112 as the flat section 232, and because the valve 212 is mounted on the flat section 232, the valve 212 is located closer to the first rotational axis 114 than if the valve 212 were mounted elsewhere on the housing exterior surface 120 at a same longitudinal position of the housing 112 as the flat section 232.

The valve 212 is mounted to the flat section 232 via a valve inner surface 234 and with this construction, the housing exterior surface 120 is located further from the rotational axis 114 than the valve inner surface 234 in a direction radially outward from the rotational axis 114 at a position of the valve 212 along the rotational axis 114. Also, a valve outer surface 236 defining on a side of the valve 212 opposite the valve inner surface 234 is located closer to the first rotational axis 114 than if the valve 212 were mounted elsewhere on the housing exterior surface 120 at a same longitudinal section of the housing 112. Consequently, a footprint of the valve 212 taken from a top view of the pneumatic fixture clamp 100 as shown in FIG. 6 is reduced, such that the valve 212 can rotate with the housing 112 and to produce a relatively small impact on an overall footprint of the housing 112 in the machine center 102 while providing selective communication between the first fluid passage section 206 and the second fluid passage section 210. Notably, while the valve 212 is depicted with a particular radial position on the housing 112 with respect to the rotational axis 114, the valve 212 may be located at any radial position on the housing 112 without departing from the scope of the present disclosure. In further alternative embodiments of the pneumatic fixture clamp 100, the valve 212 could be located elsewhere on or in the housing 112 for rotation with the housing 112.

Figure 7:
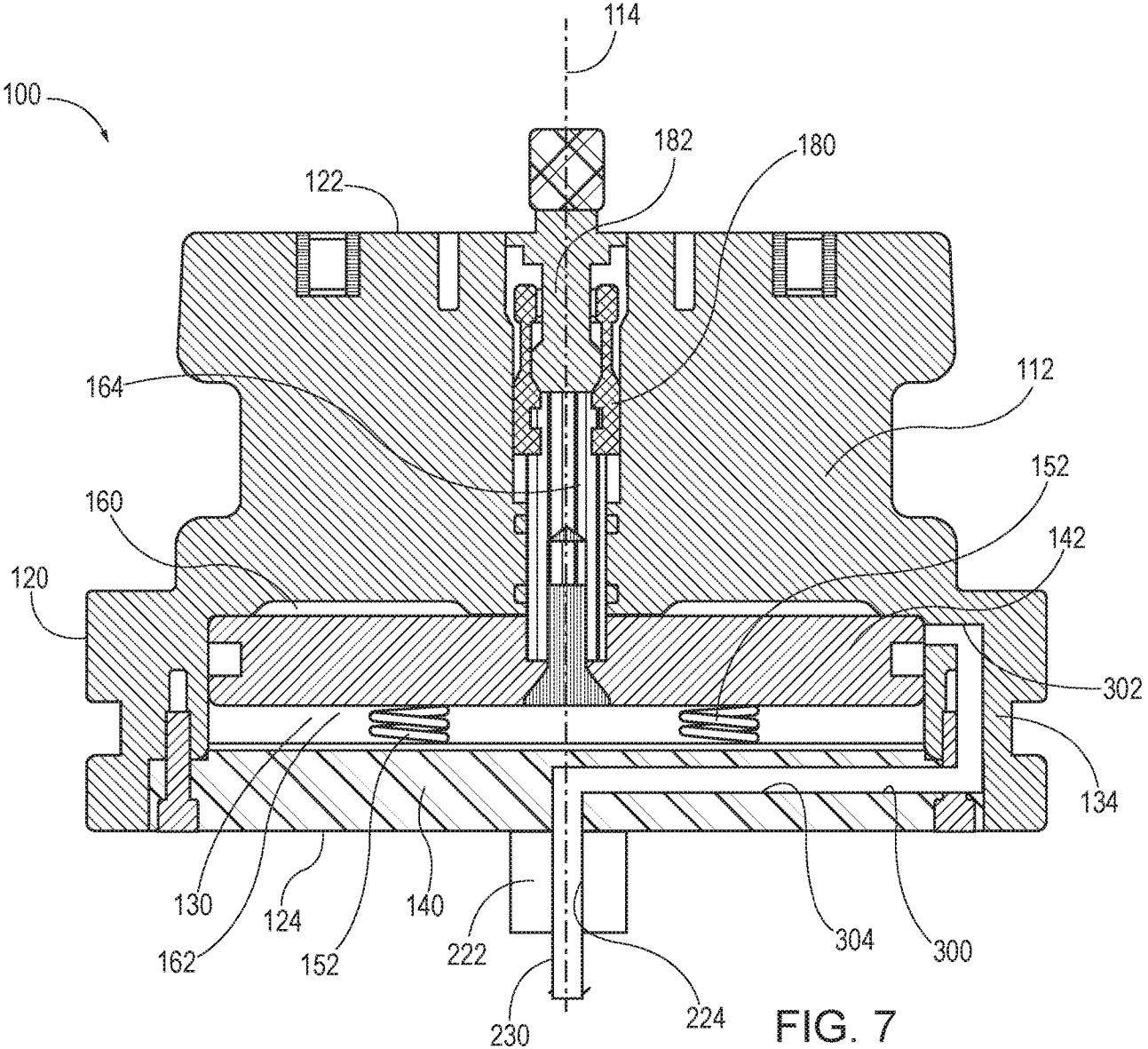
FIG. 7 is a cross-sectional view of the pneumatic fixture clamp according to another aspect of the present disclosure.

According to an embodiment of the pneumatic fixture clamp 100 depicted in FIG. 7, a fluid passage 300 is defined in the housing 112 where a first fluid passage section 302 of the fluid passage 300 extends from the first chamber part 160 of the chamber 130 and directly to a second fluid passage section 304, and the second fluid passage section 304 extends directly from the first fluid passage section 302 to the fitting 222 at the turntable engagement surface 124 of the housing 112. The first fluid passage section 302 and the second fluid passage section 304 are defined entirely in the housing 112, with the first fluid passage section 302 defined in the housing wall portion 134 and the second fluid passage section 304 defined in the housing wall portion 134 and the housing bottom portion 140.

Figure 8:
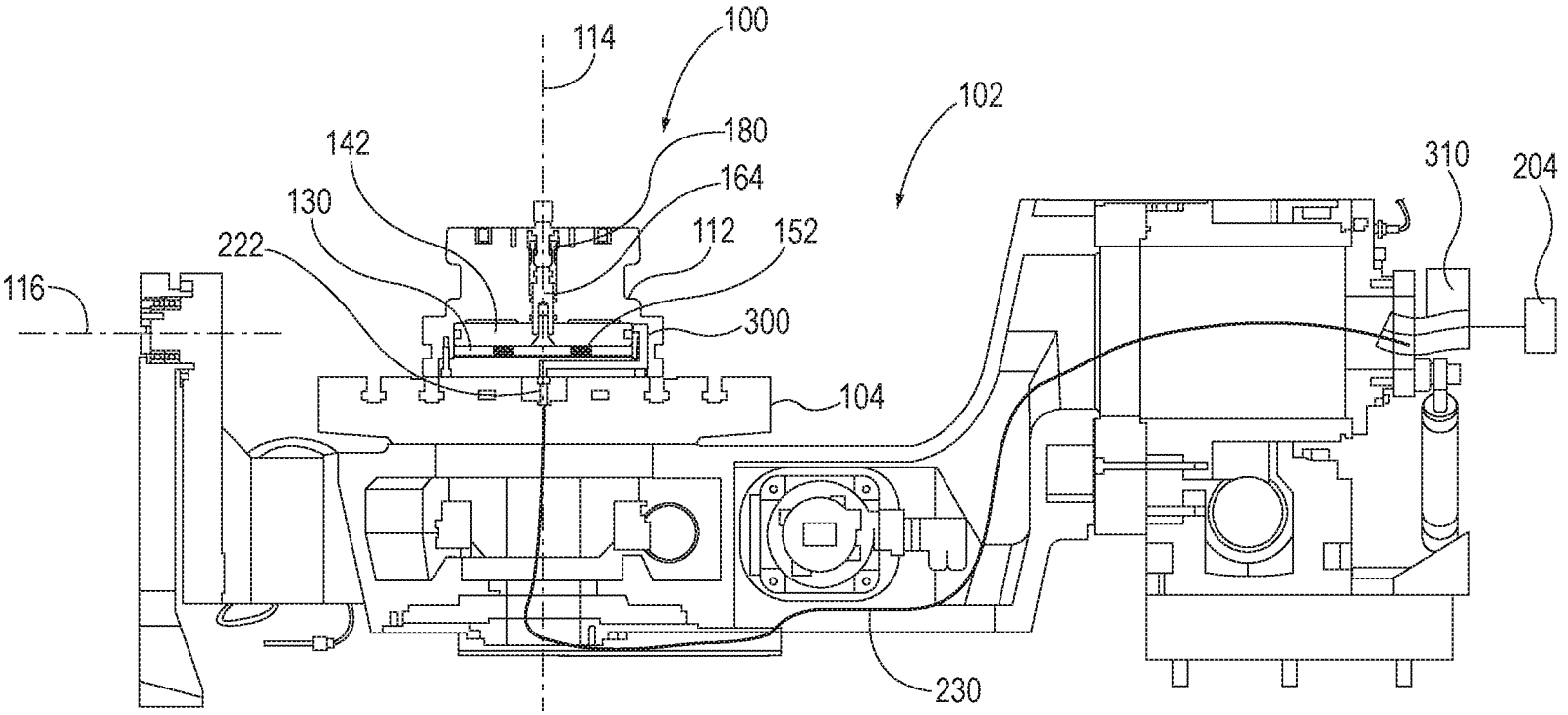
FIG. 8 is a cross-sectional view of the pneumatic fixture clamp shown in FIG. 7, installed on a machining center.

As shown in FIG. 8, the fluid passage 300 is connected to the fluid line 230 for fluid communication with a valve 310 and the pressure source 204, the valve 310 having a similar construction to the valve 212 shown in FIGS. 5 and 6. With continued reference to FIG. 8, the fluid line 230 is fixed to the fitting 222, disposed external to the housing 112, and configured for communicating fluid between the chamber 130, the ambient atmosphere, and the pressure source 204. The valve 310 is disposed on the fluid line 230, separate from the pneumatic fixture clamp 100. The valve 310 has a first operating position that brings the fluid line 230, the fluid passage 300, and the chamber 130 in fluid communication with the pressure source 204. In a second operating position, the valve 310 brings the fluid line 230, the fluid passage 300, and the chamber 130 in fluid communication with the ambient atmosphere. In this manner, the piston 142 is driven toward the retracted position when the valve 310 is in the first operating position and the pressure source 204 is actuated, and the piston 142 is biased toward the extended position by the at least one spring 152 when the valve 310 is in the second operating position.

Because the retracted state of the drawbar 164 and the locked position of the clamping mechanism 180 correspond with the retracted position of the piston 142, the retracted state of the drawbar 164 and the locked position of the clamping mechanism 180 also correspond with the first operating position of the valve 310. Similarly, because the extended state of the drawbar 164 and the open position of the clamping mechanism 180 correspond with the extended state of the piston 142, the extended state of the drawbar 164 and the open position of the clamping mechanism 180 also correspond with the second operating position of the valve 310. By selectively actuating the valve 310 between the first operating position and the second operating position, a user is able to reconfigure the clamping mechanism 180 between the locked position and the open position.

With continued reference to FIG. 8, the housing 112 is mounted on the machining center 102, the valve 310 is mounted on the machining center 102 and connected to the fluid line 230 a distance from the housing 112, and the fluid line 230 is directed through the machining center 102 from the fitting 222 to the valve 310. More specifically the valve 310 is mounted on a back portion of the machining center 102, away from the work space defined in the machining center 102 for discharging fluid from the fluid line 230 away from a user and the work space. Because the valve 310 is located on the machining center 102 a distance from the machining center 102, the turntable 104 of the machining center 102 is able to rotate without interference between the valve 310 and the machining center 102. The valve 310 is configured for remote operation and, in an embodiment, is operated from the machine user interface of the machining center 102. For the purpose of selectively connecting the chamber 130 with the pressure source 204, the valve 212 can be located anywhere on the fluid line 230 upstream of the 204.

In an embodiment, the valve 212 is mounted on the housing 112 as depicted in FIG. 6, and the valve 310 is mounted a distance from the housing 112 on the machine center 102 as depicted in FIG. 8, where the valve 212 and the valve 310 are disposed in the respective first operating position to bring the pressure source 204 in fluid communication with the chamber 130, such that a user may optionally actuate either the valve 212 or the valve 310 into the respective second operating position to bring the chamber 130 in fluid communication with the ambient atmosphere. In a further embodiment, the valve 212 is configured for being operated manually such that a user may actuate the valve 212 while maneuvering the workpiece assembly 110, and the valve 310 is configured for being operated remotely such that a user may actuate the valve 310 from a remote position with respect to the machine center 102.

As shown in FIG. 7, the fitting 222 is disposed on the housing exterior surface 120, defines the passage 224, continues the fluid passage 300 at the second fluid passage section 304, and connects the fluid passage 300 with the fluid line 230. At the fitting 222, the fluid passage 300 is defined through the turntable engagement surface 124 of the housing 112 and is centered on the first rotational axis 114. The fitting 222 is disposed and centered on the turntable engagement surface 124 of the housing 112, and connects the fluid line 230 to the housing 112. As shown in FIG. 8, the fitting 222 also directs the fluid line 230 from the housing 112 and through the turntable 104, away from the work space defined in the machining center 102. This allows the turntable 104 of the machining center 102 to rotate with the housing 112 mounted thereon, without interference between the machining center 102 and the fitting 222 or the fluid line 230.

As shown in FIG. 6, the work engagement surface 122 includes at least one precision bore 240 disposed about the first rotational axis 114. In the depicted embodiment, the at least one precision bore 240 includes four precision bores 240 disposed about the first rotational axis 114 at 90° intervals such that lines drawn respectively from consecutive precision bores 240 to the first rotational axis 114 form right angles, and the precision bores 240 are disposed at varying distances from the first rotational axis 114. The precision bores 240 are configured for receiving pins (not shown) engaged with the workpiece assembly 110, so as to prevent the workpiece assembly 110 from pivoting about the first rotational axis 114 relative to the housing 112. Notably, while the depicted set of precision bores 240 includes four precision bores 240 disposed at 90° intervals about the rotational axis 114 and at various distances from the rotational axis 114, more or fewer precision bores may be employed with alternative patterns of spacing with other precision bores, and alternative patterns of distancing from the first rotational axis 114 without departing from the scope of the present disclosure.

The work engagement surface 122 includes at least one threaded hole 242 respectively configured for receiving a screw (not shown), where the screw is configured to engage the workpiece when the workpiece is being loaded onto the pneumatic fixture clamp 100. As depicted, the at least one threaded hole 242 is four threaded holes respectively located on a line drawn between opposing precision bores 240, and the threaded holes are 10-32 United National Fine Threads (UNF) threaded holes configured for respectively receiving 10-32 UNF screws. Notably, the at least one threaded hole 242 may employ more or fewer threaded holes, may be disposed about the work engagement surface 122 without being located on a line drawn between two opposing precision bores 240, and/or may have a size other than 10-32 UNF without departing from the scope of the present disclosure.

According to an aspect of the present disclosure, a method of operating the pneumatic fixture clamp 100 includes releasing the workpiece assembly 110 from the pneumatic fixture clamp 100 by actuating the valve 212 from the first operating position, bringing the chamber 130 defined by a housing 112 in fluid communication with the pressure source 204, to the second operating position, where the chamber 130 is in fluid communication with the ambient atmosphere so as to release fluid from the chamber 130 through the fluid passage 202 defined in the housing 112. The fluid passage 202 includes the first fluid passage section 206 extending from the chamber 130 and the second fluid passage section 210 section extending from a housing exterior surface 120, such that actuating the valve 212 from the first operating position to the second operating position releases fluid through at least the first fluid passage section 206.

The method also includes driving a piston 142 slidably disposed in the chamber 130 from the retracted position to the extended position, driving the drawbar 164 from the retracted state corresponding with the retracted position of the piston 142 to the extended state corresponding with the extended position of the piston 142, and unlocking the clamping mechanism 180 from the workpiece assembly 110, the clamping mechanism 180 being connected to the drawbar distal end 172, the drawbar 164 being connected to the piston 142 at a drawbar proximal end 170. In an embodiment, the method further includes locking the workpiece assembly 110 with the pneumatic fixture clamp 100 by actuating the valve 212 from the second operating position to the first operating position, and actuating the pressure source 204 so as to introduce fluid first through the second fluid passage section 210, then the first fluid passage section 206. The method further includes driving the piston 142 from the extended position to the retracted position, driving the drawbar 164 from the extended state to the retracted state, and locking the clamping mechanism 180 to the workpiece assembly 110.

Notably, while the depicted embodiments of the pneumatic fixture clamp 100 feature the first chamber part 160 connected to the fluid passage 202 where the second chamber part 162 houses the at least one spring 152, the first chamber part 160 and the second chamber part 162 may be functionally switched such that the first chamber part 160 houses the at least one spring 152 and the second chamber part 162 is connected to the fluid passage 202 and configured for accepting fluid so as to drive the piston 142, without departing from the scope of the present disclosure.

It will be appreciated that variations of the above-disclosed embodiments and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A pneumatic fixture clamp, comprising:

a housing that defines a bore, the housing having a rotational axis passing through the bore, and a housing exterior surface, the housing exterior surface including:

a workpiece engagement surface that defines the bore, wherein the workpiece engagement surface is intersected by the rotational axis through the bore, and configured for engaging a workpiece assembly; and a turntable engagement surface disposed on a side of the housing opposite the workpiece engagement surface, intersected by the rotational axis, and configured for engaging a turntable of a machine center;

a chamber defined in the housing between the workpiece engagement surface and the turntable engagement surface along the rotational axis;

a piston slidably disposed in the chamber and configured for being driven between an extended position and a retracted position relative to the chamber;

a drawbar having a proximal end connected with the piston such that the piston is configured for driving the drawbar between an extended state and a retracted state of the drawbar which respectively correspond with the extended position and the retracted position, and a distal end connected to a clamping mechanism configured for releasably engaging a workpiece assembly; and a fluid passage defined in the housing, connected to the chamber, and configured for providing fluid from a fluid line to the chamber so as to drive the piston from the extended position toward the retracted position.

2. The pneumatic fixture clamp of claim 1, further comprising a valve having a first operating position where the chamber is in fluid communication with a pressure source and a second operating position where the chamber is in fluid communication with ambient atmosphere.

3. The pneumatic fixture clamp of claim 2, wherein the housing exterior surface is located further from the rotational axis than a valve inner surface in a direction radially outward from the rotational axis, at a position of the valve along the rotational axis.

4. The pneumatic fixture clamp of claim 2, wherein the valve is mounted on the housing exterior surface and occupies a same longitudinal position along the housing as the chamber.

5. The pneumatic fixture clamp of claim 2, wherein the valve is configured for remote operation.

6. The pneumatic fixture clamp of claim 2, wherein the housing exterior surface is substantially rounded about the rotational axis and includes a flat section to which the valve is mounted.

7. The pneumatic fixture clamp of claim 2, wherein the valve is connected to the fluid line offset from and does not rotate with the housing.

8. The pneumatic fixture clamp of claim 7, wherein the valve is mounted away from a work space defined in a machining center.

9. The pneumatic fixture clamp of claim 7, wherein the valve is mounted on a back portion of a machining center.

10. The pneumatic fixture clamp of claim 7, wherein the valve is operated from a machine user interface of a machining center.

11. The pneumatic fixture clamp of claim 1, further comprising:

a first fluid passage section formed in the fluid passage, extending from the chamber and in fluid communication with the housing exterior surface; and a second fluid passage section formed in the fluid passage, extending from the housing exterior surface and in fluid communication with the first fluid passage section.

12. The pneumatic fixture clamp of claim 11, wherein a valve is mounted to the housing exterior surface and is connected to the fluid passage between the first fluid passage section and the second fluid passage section.

13. The pneumatic fixture clamp of claim 11, wherein the first fluid passage section is directed between the chamber and a valve, and the second fluid passage section is directed between the valve and the turntable engagement surface.

14. The pneumatic fixture clamp of claim 11, wherein a valve is located on or in the housing for rotation with the housing.

15. The pneumatic fixture clamp of claim 1, wherein the fluid passage is defined entirely in the housing.

16. The pneumatic fixture clamp of claim 1, further comprising:

a fitting disposed on the housing exterior surface, defining a passage that continues the fluid passage, and connecting the fluid passage with the fluid line.

17. The pneumatic fixture clamp of claim 16, wherein the fluid passage at the fitting is defined through the turntable engagement surface.

18. The pneumatic fixture clamp of claim 17, wherein the fitting is located on the rotational axis of the housing.

19. The pneumatic fixture clamp of claim 1, further comprising at least one spring interposed between the piston and the chamber, the at least one spring configured to impose a bias on the piston toward the extended position.

20. The pneumatic fixture clamp of claim 1, wherein the piston is biased toward the extended position, and the extended position of the piston corresponds with an open position of the clamping mechanism.

* * * * *